US007108263B2

(12) United States Patent
Cabeza et al.

(10) Patent No.: US 7,108,263 B2
(45) Date of Patent: Sep. 19, 2006

(54) THREE-DIMENSIONAL LOGIC PUZZLE GAME

(75) Inventors: Félix-Abdon Pérez Cabeza, Peralta (ES); Aleksandr Ivanovich Marusenko, Zaporozhskaya (UA)

(73) Assignee: Palcan Y Bin, S.L., Peralta (Navarra) (ES)

( * ) Notice: Subject to any disclaimer, the term of this patent is extended or adjusted under 35 U.S.C. 154(b) by 0 days.

(21) Appl. No.: 11/096,370

(22) Filed: Apr. 1, 2005

(65) Prior Publication Data

US 2005/0230908 A1 Oct. 20, 2005

Related U.S. Application Data

(63) Continuation of application No. PCT/UA03/00031, filed on Sep. 23, 2003.

(30) Foreign Application Priority Data

Oct. 1, 2002 (UA) ..... 2002107789

(51) Int. Cl.
*A63F 9/08* (2006.01)

(52) U.S. Cl. ..... 273/153 S

(58) Field of Classification Search ..... 273/153 S
See application file for complete search history.

(56) References Cited

U.S. PATENT DOCUMENTS

| | | | | | |
|---|---|---|---|---|---|
| D274,280 | S | * | 6/1984 | Kremer | 273/153 S |
| 4,522,401 | A | * | 6/1985 | Gustafson | 273/153 S |
| 4,856,786 | A | * | 8/1989 | Gyovai | 273/153 S |
| 4,865,323 | A | * | 9/1989 | Heusinkveld | 273/153 S |
| 5,358,247 | A | * | 10/1994 | Meffert | 273/153 S |
| 5,816,571 | A | * | 10/1998 | Chen | 273/153 S |
| 6,769,690 | B1 | * | 8/2004 | Khoudary | 273/153 S |

* cited by examiner

*Primary Examiner*—Steven Wong
(74) *Attorney, Agent, or Firm*—Klauber & Jackson

(57) ABSTRACT

A three-dimensional logic puzzle game made in the form of a sphere comprising game-playing elements of two types formed by dissection of the sphere by three planes perpendicular to the vertical axis thereof, and connecting elements, each of them connecting two adjacent game-playing elements of the same type, differing in the game-playing elements being formed by additional dissection of the sphere by three planes perpendicular to its one horizontal axis and by three planes perpendicular to its other horizontal axis perpendicular to the first one, three planes dissecting the sphere being center planes and six planes cutting off six osculating spherical segments having the same geometrical dimensions, the game-playing elements of the first type being limited by two rectangular and one convex arc-like sides provided with shaped grooves made therein.

4 Claims, 4 Drawing Sheets

THREE-DIMENSIONAL LOGIC PUZZLE GAME

RELATED APPLICATIONS

The present application is a Continuation of co-pending PCT Application No. PCT/UA2003/000031, filed on Sep. 23, 2003 which in turn, claims priority from Ukrainian Patent Application Serial No. 2002107789, filed on Oct. 1, 2002. Applicants claim the benefits of 35 U.S.C. §120 as to the PCT application and priority under 35 U.S.C. §119 as to said Ukrainian application, and the entire disclosures of both applications are incorporated herein by reference in their entireties.

FIELD OF THE INVENTION

The present invention relates to puzzle games and can be used for developing logical thinking and spatial imagination of players or as an educational visual aid when teaching geography, combinatorial analysis and other educational disciplines.

BACKGROUND OF THE INVENTION

Known in the art is a three-dimensional logic puzzle game (see the USSR I. C. No. 1452535, M. Кл. A63F 9/08 of Nov. 3, 1986, published Jan. 23, 1989) made as a sphere comprising game-playing elements of two types which are formed by dissecting the sphere by three planes perpendicular to the vertical axis thereof.

In the known puzzle game the sphere is also dissected by meridian planes. To connect the two types of game-playing elements formed by this dissection of the sphere, the game-playing elements of one type are provided with grooves, while the game-playing elements of the second type are provided with projections. The known three-dimensional logic puzzle game incorporates a hinging unit allowing the game-playing hemispheres to turn in the meridian plane and featuring a shroud ring with a guiding closed groove made on the interior surface. The game-playing elements adjoining the poles have projections which form, when matched, central locating cylinders to interact with the guiding groove of the shroud ring.

Because of its complex design the known three-dimensional logic puzzle game is difficult in fabrication and insufficiently interesting.

The low fabricability is accounted for by the fact that the process of assembly of the known puzzle game is complicated by presence of the shroud ring. Moreover, the shroud ring that envelopes the sphere covers the game-playing elements, while the game-playing elements can only move in layers about the vertical axis or revolve hemi-spherically in the meridian planes, which requires no high mental strain on the part of the player. This reduces the entertaining potential of the game.

As regards its technical substance and technical result achieved, the closest analog of the claimed three-dimensional logic game is the one described in RF Patent No. 2064315, M. Кл. A63F9/08 of Jun. 2, 1993, published Jul. 27, 1996 and featuring a sphere comprising game-playing elements of two types formed by dissecting the sphere by three planes perpendicular to the vertical axis thereof, and connecting elements, each of which connecting two adjacent playing elements of the same type.

In the known three-dimensional logic game puzzle, the sphere is also dissected by meridian planes. To connect the two types of game-playing elements formed by such a dissection of the sphere, use is made of arc-like connecting elements of two types. Placed on the vertical axis of the sphere, at the polar points, in the grooves of the game-playing elements of the first type having a shape of a spherical triangle, are washers one of which is rigidly fixed by pins to the game-playing element of the first type, while the other moves freely being non-attached to anything. The adjacent game-playing elements of the first type are interconnected with the aid of connecting elements of the first type, while the connecting elements of the other type are designed to interconnect the adjacent game-playing elements of the second type shaped as spherical parallelograms at the point where these are dissected by a center plane, one such connecting element being rigidly attached with pins to a game-playing element of the second type. The game-playing elements of the second type have three types of grooves to connect to the game-playing elements of the first type and to one another, while the geometrical dimensions of these grooves in one hemisphere differ from the geometrical dimensions of the grooves in the other hemisphere. The game-playing element of the first type has a T-shaped projection to engage the adjacent game-playing elements of the second type, while the connecting element has two projections, on its one side the T-shaped projection extending through its entire length, while on the other side a narrow projection is provided extending through more than half the element's length and then passing into a T-shaped projection. The game-playing elements of the known puzzle game can move in layers with respect to the sphere's vertical axis or rotate hemi-spherically in the meridian planes through an angle of 180° and angles multiple thereof.

The known three-dimensional logic puzzle game has a complex design, which complicates its fabrication and makes it insufficiently entertaining.

The above is due to the fact that the known puzzle game has a large number of various assembly units and fasteners. Considering that the diameter of such puzzle games never exceeds 120 mm, the assembly units and, especially, the fasteners are made rather small in size. At the same time, different kinds of grooves and projections provided on the assembly units render them non-exchangeable while requiring high precision of fabrication thereof. Even a smallest deviation from the established dimensions may result in sticking of the game-playing elements. Besides, the use of fasteners, such as pins, and washers impairs reliability of the puzzle game in work and increases consumption of labor on its production. The puzzle game thus becomes insufficiently interesting, because the game-playing elements can only be moved layer by layer about the vertical axis or can be rotated hemi-spherically in the meridian planes, which does not require much mental work on the part of the player.

DESCRIPTION OF THE INVENTION

The task behind the present invention is to improve the three-dimensional logic puzzle game by making its structural elements anew and introducing new ties between the structural members, thus simplifying the design of the game and, as a result, improving its fabricability while simultaneously increasing its entertaining potential.

This task can be solved by that, in accordance with the invention, in a three-dimensional logic puzzle game embodied in the form of a sphere, which comprises two types of game-playing elements formed by dissection of the sphere by three planes perpendicular to the vertical axis thereof, and connecting elements, each of which connecting two adjacent game-playing elements of one type, a novelty resides in the fact that the game-playing elements are formed by additional dissection of the sphere by three planes perpendicular to one horizontal axis thereof, and by three planes perpendicular to its other horizontal axis, which is perpendicular to the first one, with three of the planes dissecting the sphere being diametrical and six ones cutting off six osculating spherical segments having the same geometrical dimensions, and the game-playing elements of the first type are limited by two rectangular and one convex arc-like sides provided with shaped grooves made therein, while the game-playing elements of the second type are limited by two concave ark-like sides provided with projections to fit the shaped grooves made in the convex ark-like sides of the first type, besides which, the shaped grooves of the convex ark-like sides of the game-playing elements of the first type are provided with rounded lugs, and the projections of the game-playing elements of the second type are provided with the recesses fitting them, the connecting elements connect the adjacent game-playing elements of the first type and are embodied in the form of two parallel guides connected with the aid of a jumper, the lower part of which has recesses on either side of the longitudinal axis thereof, while the lower horizontal planes of the shaped grooves made in the rectangular sides of the game-playing elements of the first type are provided with inclined elastic latches matching the said recesses, the connecting elements having a bend corresponding to the bend of the game-playing elements of the first type.

The cause-effect relation between the plurality of limitations of the claimed invention and technical result to be achieved resides in the following.

The claimed three-dimensional logic puzzle game comprises but three types of assembly units, that is, the game-playing elements of the first type, which are limited by two rectangular and one convex arc-like sides, the game-playing elements of the second type limited by three concave arc-like sides, and the connecting elements embodied in the form of two guides linked by a jumper. Due to dissection of the sphere by three center planes and six planes cutting off six osculating spherical segments, twenty four game-playing elements of the first type and eight game-playing elements of the second type are formed. All of the six osculating spherical segments have the same geometrical dimensions with the result that all the game-playing elements of the first and second types also have the same geometrical dimensions, which fact makes them interchangeable. The connecting elements are designed to connect the game-playing elements to one another. The guides of each connecting element are accommodated in the shaped grooves made in the rectangular sides of the adjacent game-playing elements of the first type. The game-playing elements of the second type whose projections fit the shaped grooves made in the convex arc-like sides of the game-playing elements of the first type connect the spherical segments together thus forming a sphere. Once embodied this way, the game-playing elements also form, apart from the six osculating spherical segments capable of revolving right and left about their centers, six spherical layers and six spatial hemispheres, which can also rotate around the vertical and two horizontal axes of the sphere. Inasmuch as the game-playing elements can move in different directions, it is now possible to create a large number of different combinations, which makes the three-dimensional logic puzzle game much more interesting. For reliable orientation and fixation of the game-playing elements of the first type relative to the game-playing elements of the second type, the shaped grooves made in the convex arc-like sides of the game-playing elements of the first type are provided with rounded lugs, while the projections of the game-playing elements of the second type are provided with recesses to match them. This makes correct orientation of the spherical layers and hemispheres easier after these cease to rotate. As the spherical segments rotate, the reliability of orientation of game-playing elements of the first type relative to one another and with respect to connecting elements is assured by the recesses made in lower parts of the jumpers of connecting elements on either side of their longitudinal axes and elastic latches matching these recesses and made in the lower horizontal planes of the shaped grooves made in the rectangular sides of game-playing elements of the first type. The recesses provided in the lower part of the jumpers are made in the form of ratchet teeth, while the elastic latches are made as ratchet pawls. Thus a ratchet-and-pawl gear is formed wherein a snap latch engages, when the game-playing elements of the first type move in opposite directions, the base of the recess in the lower part of the jumper and interlocks the game-playing elements with respect to connecting elements and to one another. The design of the claimed three-dimensional logic puzzle game requires no fasteners or additional connecting elements. This appreciably decreases the input of labor into its fabrication and enhances its reliability in work. The simplified design and better fabricability help decrease the expenditures of materials and energy required for fabrication of the puzzle game.

BRIEF DESCRIPTION OF THE DRAWINGS

The invention will be explained in more detail in conjunction with the appended drawings, wherein.

Figure 1:
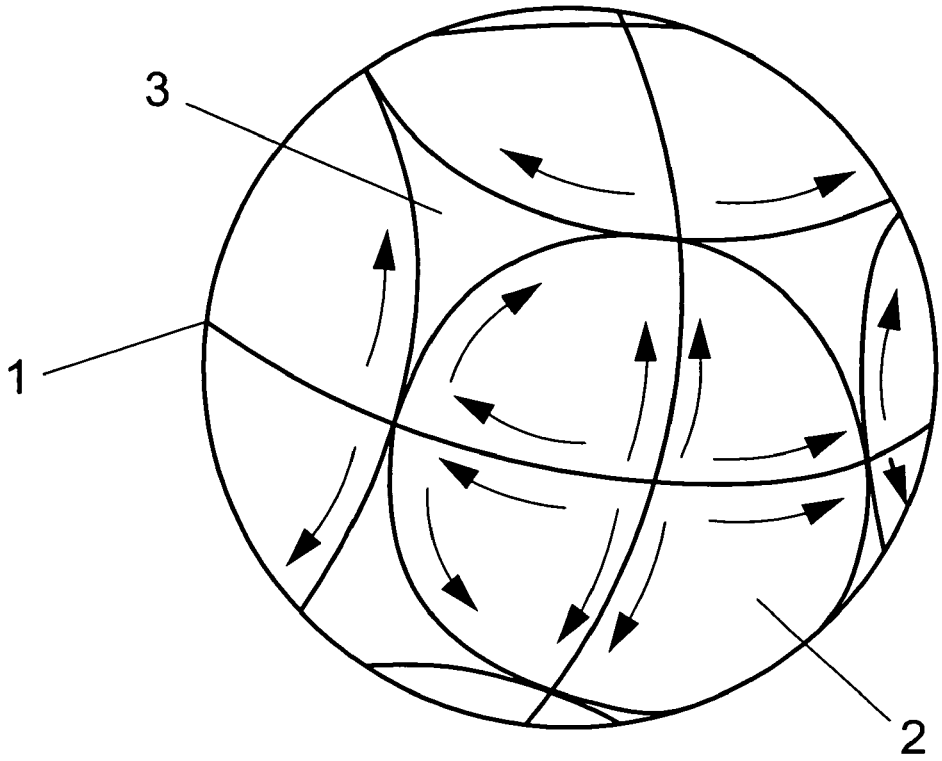
FIG. 1 is a general view of the inventive three-dimensional logic puzzle game.
Figure 2:
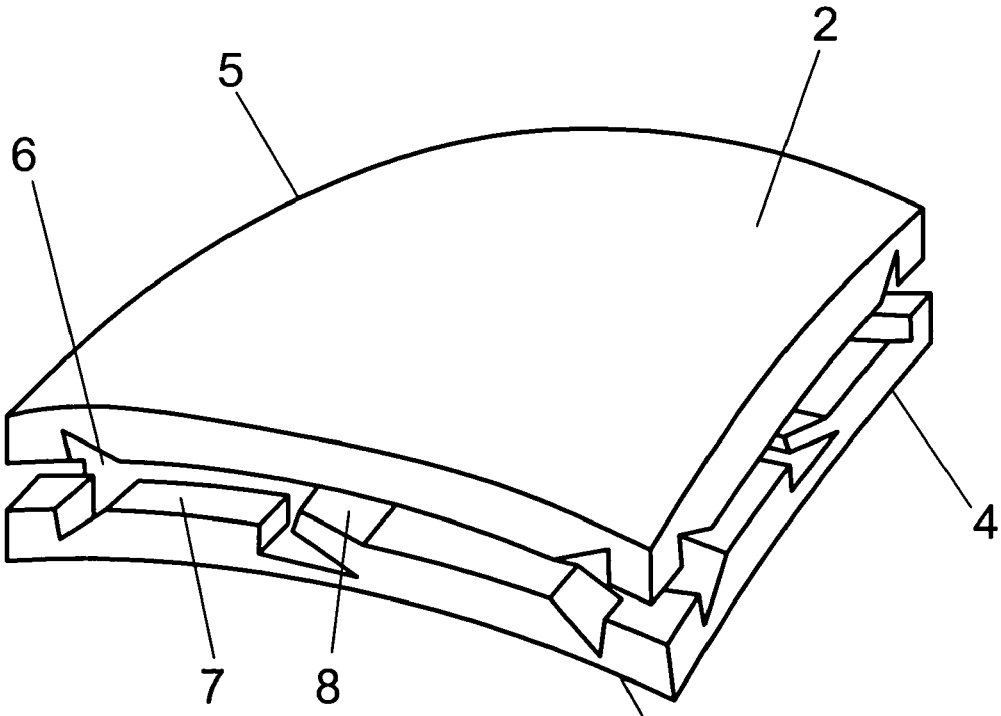
FIG. 2 is a general view of a game-playing element of the first type, showing its rectangular sides.
Figure 3:
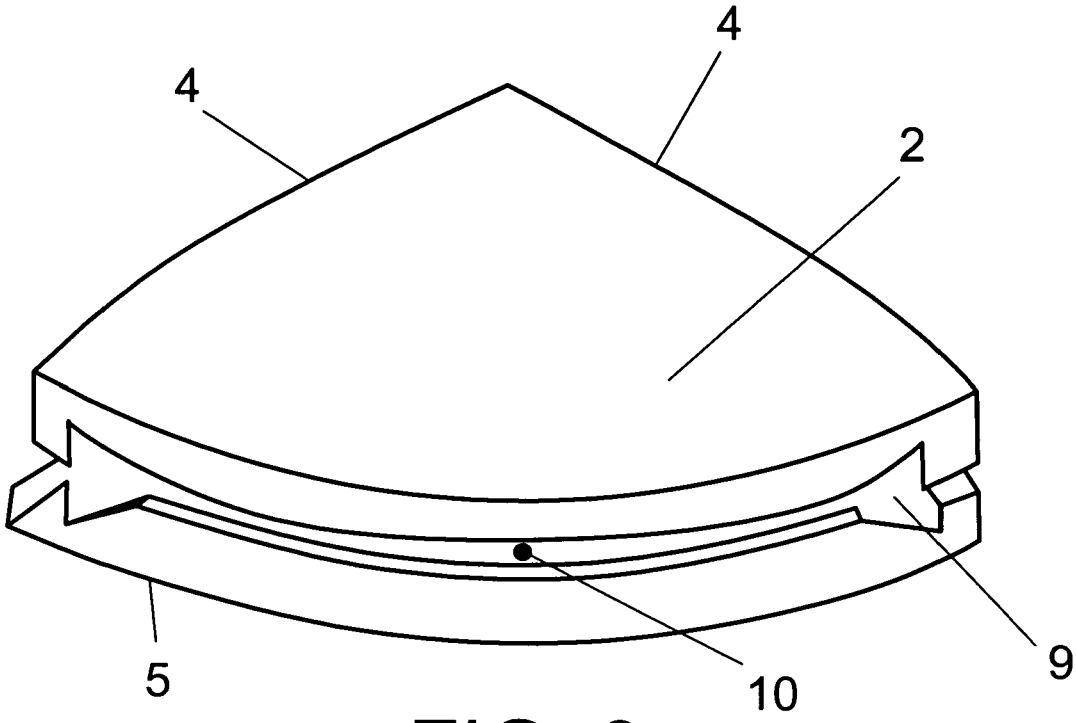
FIG. 3 is a general view of the same, showing its convex arc-like side.
Figure 4:
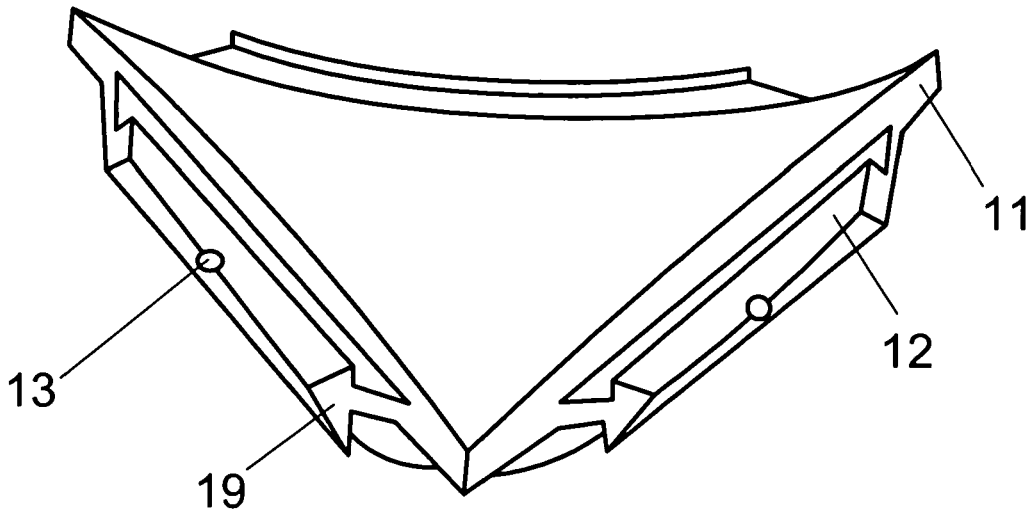
FIG. 4 is a general view of a game-playing element of the second type.
Figure 5:
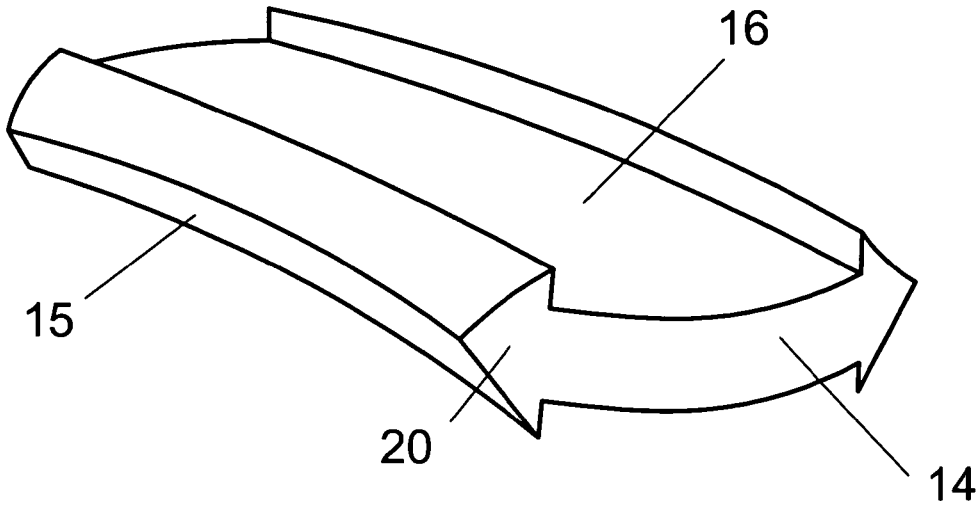
FIG. 5 is a view of a connecting element.
Figure 6:
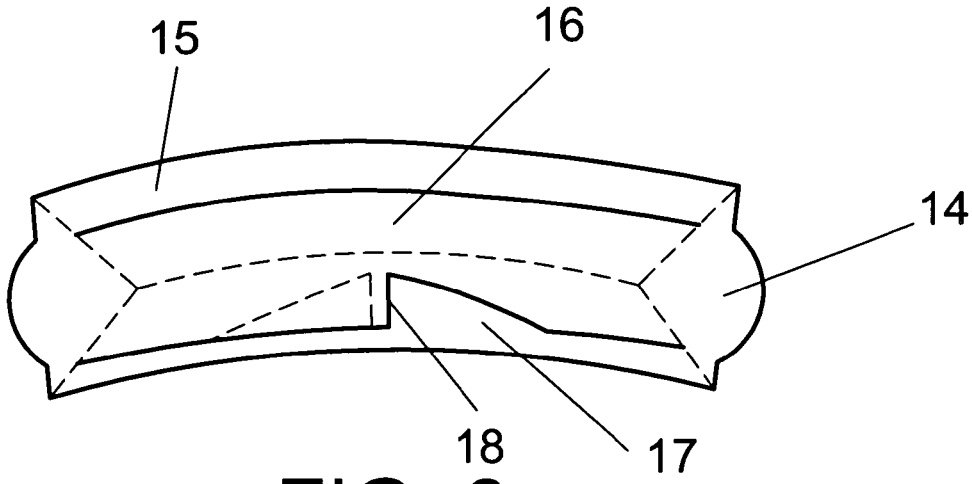
FIG. 6 is a longitudinal section of the same.
Figure 7:
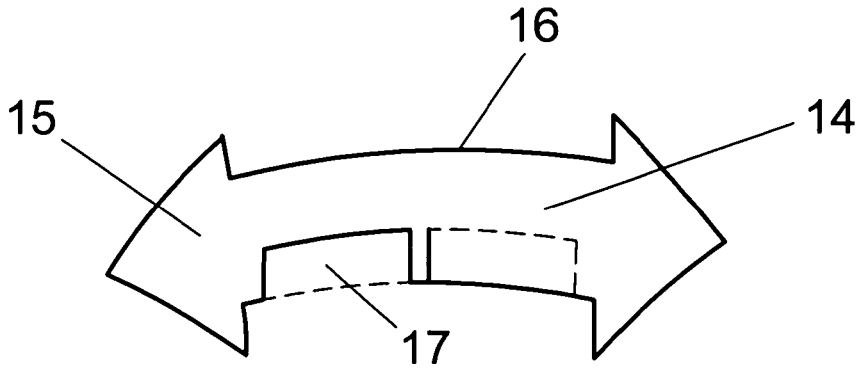
FIG. 7 is a lateral section of the same.
Figure 8:
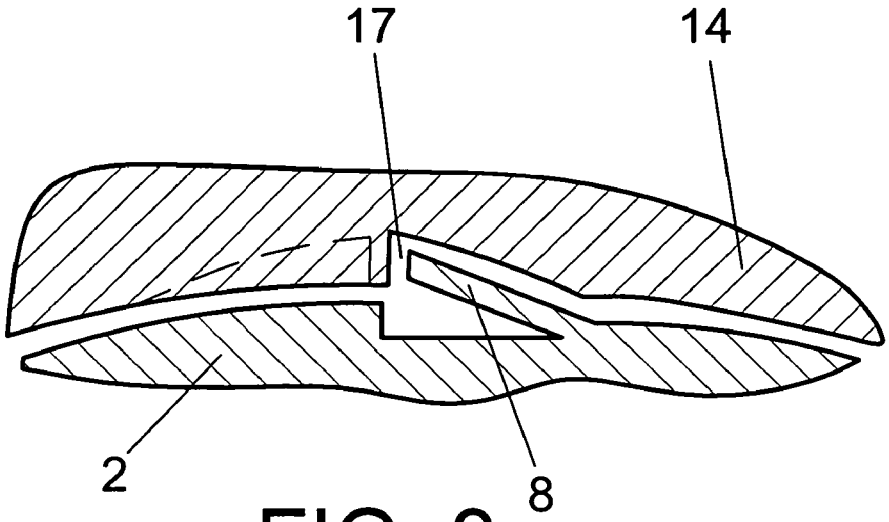
FIG. 8 shows a scheme of engagement of the elastic latches with recesses made in the lower portion of the jumpers of connecting elements.
Figure 9:
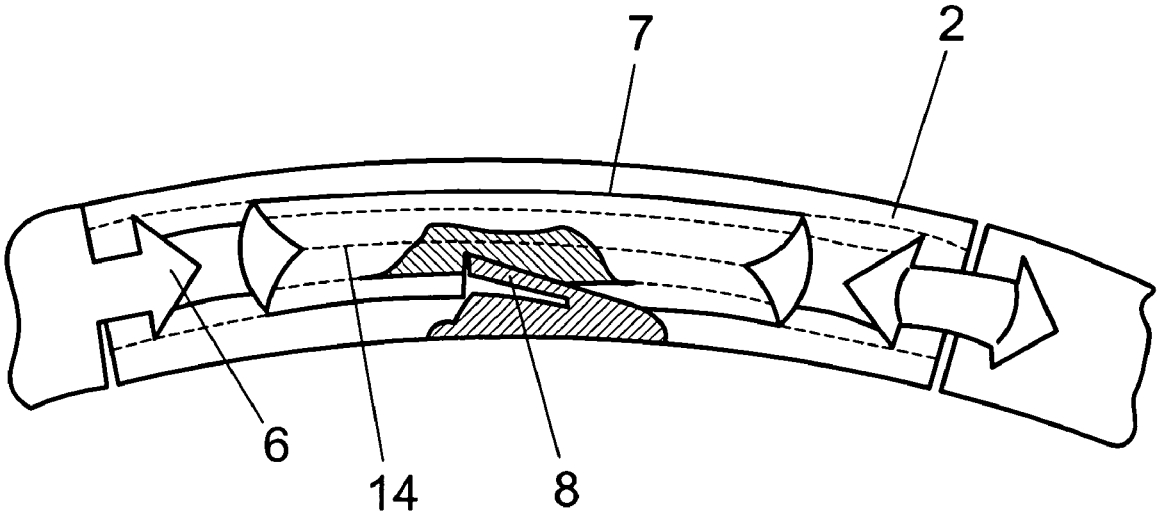
FIG. 9 is a diagram showing arrangement of the guides of connecting elements in the shaped grooves of game-playing elements of the first type.

The three-dimensional logic puzzle game is embodied in the form of hollow sphere 1 and comprises game-playing elements 2 of the first type and game-playing elements 3 of the second type formed by dissection of the sphere by three center planes and by six planes cutting off six osculating spherical segments having the same geometrical dimensions. Game-playing elements 2 of the first type have two rectangular sides 4 and one convex arc-like side 5. Rectangular sides 4 have shaped grooves, lower horizontal planes 7 of which mount elastic latches 8. Convex arc-like sides 5 of game-playing elements 2 are provided with shaped grooves 9 with rounded lugs 11 in the center. Game-playing elements 3 of the second type have each three concave arc-like sides 11 provided with projections 12 to fit shaped grooves 9 made in arc-like sides 5 of game-playing elements 2. Projections 12 have, in the center thereof, recesses to fit rounded lugs 10. Game-playing elements 2 of the first type and game-playing elements 3 of the second type are connected to one another with use of projections 12, which engage shaped grooves 9. Connecting elements 14 connect adjacent game-playing elements 2 together and have two parallel guides 15 linked by jumper 16. Jumpers 16 are provided with recesses 17 made in the lower portions and on either side of the longitudinal axes thereof. Recesses 17 may be made, for example, in the form of oblique triangular prisms whose bases 18 are set in the middle of jumpers 16 at right angles to the lower surfaces thereof. The apexes of the prisms point in opposite directions and gradually pass into the surface of jumper 16. Connecting elements 14 have a bend which matches the bend of game-playing elements 2 of the first type. Projections 12 of game-playing elements 3 and guides 15 of connecting elements 14 have the same, say, triangular, shape. Facial angles 19 of projections 12 and facial angles 20 of guides 15 are rounded.

DESCRIPTION OF AN EMBODIMENT OF THE INVENTION

The three-dimensional logic puzzle game works as follows.

Game-playing elements 2 of the first type and game-playing elements 3 of the second type that form sphere 1 are moved or rotated to restore their position in which a correct image is obtained on sphere 1. Meanwhile, as shown in FIG. 1, each spherical segment formed by four game-playing elements 2 of the first type may rotate right or left relative to its central point. The spherical layers, each of which being formed by eight game-playing elements 2 of the first type and four game-playing elements 3 of the second type, may successively move in the direction of the inclination of elastic latch 8, which are positioned on lower horizontal planes 7 of the shaped grooves made on rectangular sides 4 of game-playing elements of the first type, and in the opposite direction till elastic latches 8 interlock with bases 18 of prismatic recesses 17 made in the lower portions of jumpers 16 of connecting elements 14. Each of the six hemispheres can move in the same direction with respect to the central point of sphere 1. Orientation and fixation of game-playing elements 2 of the first type relative to game-playing elements 3 of the second type is assured due to the fact that rounded lugs 10, which are set in the center of shaped grooves 9 made in arc-like sides 5 of game playing element 2 of the first type, enter recesses 13, which are located on projections 12 made in concave arc-like sides 11 of game-playing elements 3 of the second type. The spherical layers, spherical segments and hemispheres move on guides 15 of connecting elements 14 and on projections 12 made on concave arc-like sides 11 of game-playing elements 3 of the second type. Inasmuch as facial angles 19 of projections 12 and facial angles 20 of guides 15 are rounded, the spherical layers, spherical segments and hemispheres can move and rotate freely thus precluding sticking of the game-playing elements of the three-dimensional logic puzzle game, which ensures freedom of movement for all the elements.

The inventive three-dimensional logic puzzle game has a stable and reliable design while being simpler in design, more adaptable to fabrication process and more interesting.

INDUSTRIAL APPLICABILITY

The three-dimensional logic puzzle game may carry a map of the Earth with its continents, oceans, rivers, countries, cities shown on it, which map may be geographic, physical or political. This also may be a map of the lunar surface or the surface of some other planet, or some pattern. Game-playing elements 2 and 3 may also feature mathematical problems with respective solution keys provided, etc.

The inventive three-dimensional logic puzzle game comprises twenty four game-playing elements 2 of the first type, eight game-playing elements 3 of the second type and twenty four connecting elements 14. All the elements of the puzzle game can be cast from polymers using the existing industrial equipment.

The invention claimed is:

1. A three-dimensional logic puzzle game made in the form of a sphere comprising game-playing elements of two types formed by dissection of the sphere by three planes perpendicular to the vertical axis thereof, and connecting elements, each of them connecting two adjacent game-playing elements of the same type, wherein the game-playing elements are formed by additional dissection of the sphere by three planes perpendicular to its one horizontal axis and by three planes perpendicular to its other horizontal axis perpendicular to the first one, three planes dissecting the sphere being center planes and six planes cutting off six osculating spherical segments having the same geometrical dimensions, wherein the game-playing elements of the first type are limited by two rectangular and one convex arc-like sides provided with shaped grooves made therein, while the game-playing elements of the second type are limited by three concave arc-like sides provided with projections made to fit the shaped grooves made in the convex arc-like sides of the game-playing elements of the first type.

2. The three-dimensional logic puzzle game of claim 1, wherein the shaped grooves made in the convex arc-like sides of the game-playing elements of the first type are provided with rounded lugs made therein, and the projections of the game-playing elements of the second type have the recesses fitting them, the connecting elements connect adjacent game-playing elements of the first type and are in the form of two parallel guides connected with the aid of a jumper, whose lower portion is provided with recesses made on either side of the longitudinal axis thereof.

3. The three-dimensional logic puzzle game of claim 2, wherein the lower horizontal planes of the shaped grooves made in the rectangular sides of the game-playing elements of the first type are provided with inclined elastic latches fitting these recesses, and the connecting elements have a bend matching the bend of the game-playing elements of the first type.

4. A three-dimensional logic puzzle game made in the form of a sphere comprising game-playing elements of two types formed by dissection of the sphere by three planes perpendicular to the vertical axis thereof, and connecting elements, each of them connecting two adjacent game-playing elements of the same type, wherein the game-playing elements are formed by additional dissection of the sphere by three planes perpendicular to its one horizontal axis and by three planes perpendicular to its other horizontal axis perpendicular to the first one, three planes dissecting the sphere being center planes and six planes cutting off six osculating spherical segments having the same geometrical dimensions;

wherein the game-playing elements of the first type are limited by two rectangular and one convex arc-like sides provided with shaped grooves made therein, while the game-playing elements of the second type are limited by three concave arc-like sides provided with projections made to fit the shaped grooves made in the convex arc-like sides of the game-playing elements of the first type;

wherein the shaped grooves made in the convex arc-like sides of the game-playing elements of the first type are provided with rounded lugs made therein, and the projections of the game-playing elements of the second type have the recesses fitting them, the connecting elements connect adjacent game-playing elements of the first type and are in the form of two parallel guides connected with the aid of a jumper, whose lower portion is provided with recesses made on either side of the longitudinal axis thereof; and wherein the lower horizontal planes of the shaped grooves made in the rectangular sides of the game-playing elements of the first type are provided with inclined elastic latches fitting these recesses, and the connecting elements have a bend matching the bend of the game-playing elements of the first type.

* * * * *